United States Patent [19]

Graser

[11] 4,328,923

[45] May 11, 1982

[54] PICNIC COOLER CONTAINER

[75] Inventor: Earl J. Graser, Monroe, La.

[73] Assignee: Johns-Manville Corporation, Denver, Colo.

[21] Appl. No.: 86,867

[22] Filed: Oct. 22, 1979

[51] Int. Cl.[3] ..... B65D 5/24

[52] U.S. Cl. ..... 229/33; 206/45.29

[58] Field of Search ..... 229/31 R, 33, 31 FS, 229/DIG. 3; 206/45.29

[56] References Cited

U.S. PATENT DOCUMENTS

| | | | |
|---|---|---|---|
| 1,718,204 | 6/1929 | Lupton | 229/31 FS X |
| 1,813,298 | 7/1931 | Klin | 206/45.29 |
| 2,377,125 | 5/1945 | Borah et al. | 229/31 R |
| 2,810,506 | 10/1957 | Kessler | 229/31 R |
| 3,511,429 | 5/1970 | Brian | 229/31 FS |

FOREIGN PATENT DOCUMENTS

| | | | |
|---|---|---|---|
| 1527601 | 4/1968 | France | 229/31 R |
| 1527602 | 4/1968 | France | 229/31 R |
| 959208 | 5/1964 | United Kingdom | 229/31 FS |

*Primary Examiner*—Stephen P. Garbe

*Attorney, Agent, or Firm*—Robert M. Krone; Joseph J. Kelly; Norvell E. Von Behren

[57] ABSTRACT

A picnic cooler container is disclosed which is utilized in packaging a plurality of multiple articles such as cans of beverage or the like. The cans are inserted into the container through the ends of the container package. The container is designed to be opened by the purchaser of the container with the container being designed to receive a quantity of bulk ice placed on top of the plurality of multiple articles. The container comprises a plurality of side and end panels which have hingedly connected thereto side and end flaps which are glued down for shipping and transporting without the ice. The side and end flaps may then be pulled up and formed into an upper water-proof well area which retains the bulk ice on top of the multiple articles packaged in the lower water-proof container area.

10 Claims, 10 Drawing Figures

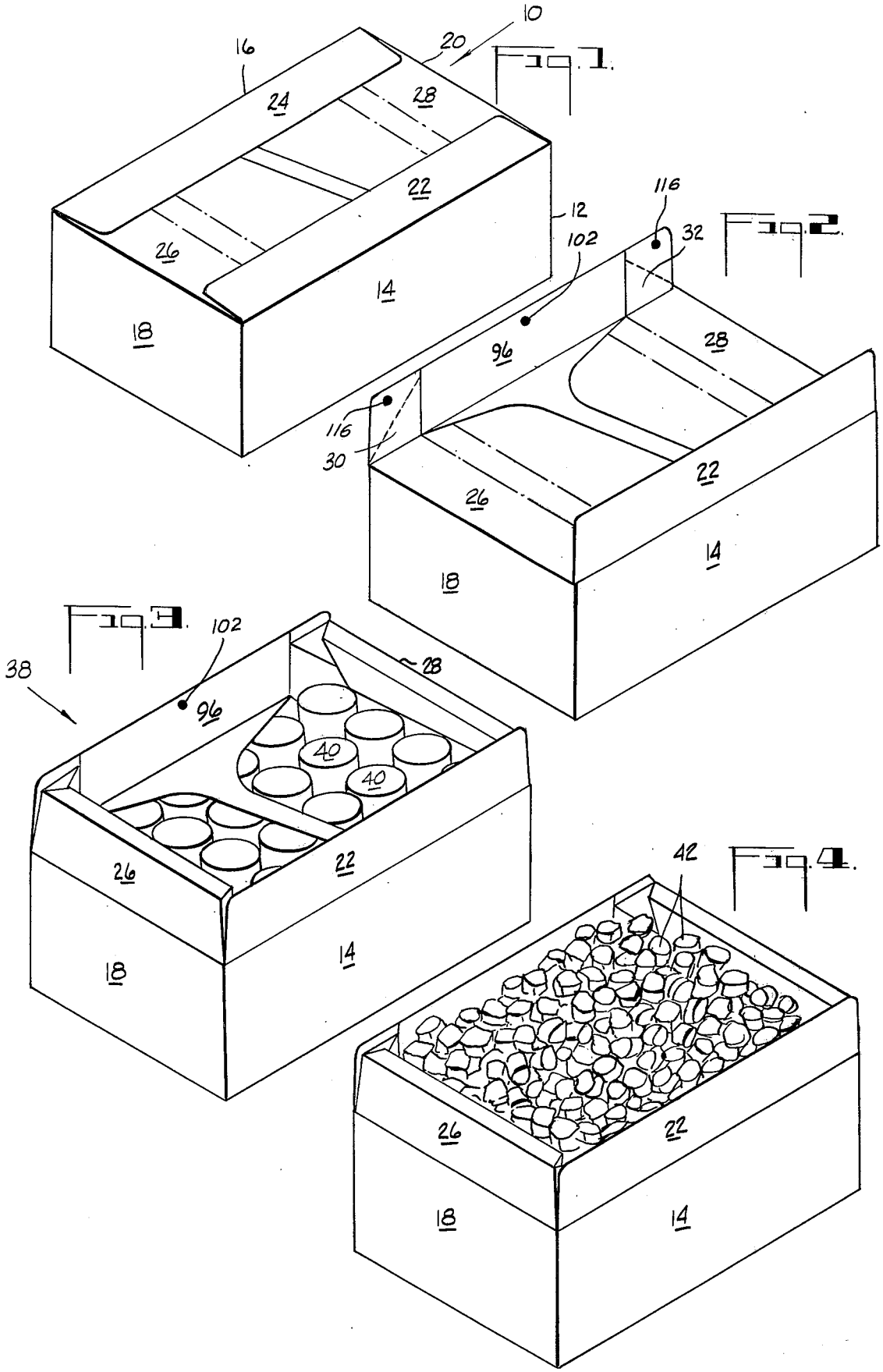
10
16
20
24
28
22
26
12
14
18
116
32
102
96
28
116
30
22
26
14
18
102
38
28
96
40
40
26
22
14
18
42
26
22
18
14

FRONT SIDE OF BLANK
(OUTSIDE OF PACKAGE WHEN SET-UP)
(BACK)
(FRONT)

152
156
150
154
136
96
28
20
14
36
10
9
44
54
192
32
162
160
22
148
146
144
142
158
102
26
120
18
116
30
104

PICNIC COOLER CONTAINER

BACKGROUND OF THE INVENTION

This invention relates generally to a picnic cooler container and specifically to a new and novel container package which may be used to carry a plurality of multiple articles and to then retain a bulk quantity of ice on top of the multiple articles.

During the hot summers, it is desirable to have a quantity of iced beverages such as soda or beer available for use as desired. Normally the purchaser of these beverages would purchase a standard quantity of the beverages at a local store and would then transfer the beverages to a typical ice chest of the type commonly used today. Thereafter the consumer would purchase a quantity of bulk ice and place on top of the cans of beverage for later use.

It is also known to provide paperboard containers which are capable of handling a predetermined amounts of bulk ice to ice various products packaged within the container. For example, in the U.S. Pat. No. 2,467,268, issued Apr. 12, 1949 to G. Merkle, there is taught a corrugated shipping container designed for shipping fish, oysters, clams and other thermal sensitive products using dry ice as a refrigerating medium. This package uses separate refrigerant chambers for containing the dry ice as shown in FIG. 2 of the drawing.

There is also provided in prior art containers, packages which are capable of receiving a bulk quantity of ice which is positioned above the material to be cooled. Typical patents showing these types of containers are the U.S. Pat. Nos. 2,915,235, issued Dec. 1, 1959 to D. E. Rueckert; 2,989,176, issued June 20, 1961 to C. S. Hasselhoff and 3,196,021, issued July 20, 1965 to R. E. Oas, et al. Each of these patents teaches a container which allows the icing on the tops of cans or other products with the containers generally being standard known types of refrigerating containers having at least a top lid and possibly a bottom lid.

There is also taught other specialty types of containers which are designed for packaging of products with the storage of ice above the products has shown in the U.S. Pat. No. 3,462,010, issued Aug. 19, 1969 to J. P. Hamilton, et al. This patent teaches a package combination using a transparent film-like bag, sleeve or wrapper for securing the multiple articles against shifting and for containing the quantity of bulk ice above the containers as shown in FIG. 13 of the drawing.

It is known also in the art to provide portable beverage coolers constructed of water-resistant paperboard and which are capable of being used with a quantity of bulk ice. Such a cooler is shown in U.S. Pat. No. 3,511,429, issued May 12, 1970 to J. A. Brian. It is also known in the art to provide reusable collapsible shipping containers which may be quickly set up and loaded through the ends of the container. Such a container is shown in U.S. Pat. No. 4,094,458, issued June 13, 1978 to B. C. Nelson, Jr. While each of the before mentioned prior art type containers may have functioned for the desired purpose intended, it will become clear from a review of the foregoing specification that none of the containers may be utilized in the new and novel manner of the Applicant's container.

SUMMARY OF THE INVENTION

There has been provided by the subject invention a new and novel picnic cooler container which is designed for packaging a plurality of multiple articles by end loading the articles into the container. The container is also designed to be opened at the top thereof by the purchaser of the structure and to receive a quantity of bulk ice which is placed on top of the plurality of multiple articles.

The container comprises basically a lower water-proof container section comprising a plurality of side and end flaps and also an upper water-proof well area formed from a plurality of top side and end flaps which are hingedly attached to the lower side and end panels. The top side and end flaps are folded downwardly and are positioned horizontally over the multiple articles prior to ice being applied to the package. The flaps are designed so that they cover the tops of the multiple articles and yet may be repositioned to a vertical position to thereby provide the upper water-proof well area capable of receiving the bulk ice.

Accordingly it is an object and advantage of the invention to provide a new and novel picnic cooler container which may be adapted for storing of multiple containers and which also may be used for icing of the containers by simply lifting predetermined flaps from the top portion of the container.

Another object and advantage of the invention is to provide a new and novel picnic cooler container which may be set up from a production blank and end filled in a high speed packaging line and shipped to the ultimate consumer.

Still yet another object and advantage of the invention is to provide a water-tight picnic cooler container which is capable of receiving a large quantity of bulk ice on top of the cans or bottles contained within the container.

A further object and advantage of the invention is to provide a new and novel production blank for a picnic cooler which may be set up into an end loaded container of the type capable of receiving a plurality of beverage containers in the bottom thereof with provisions being made in the package for quick set up of an upper water-proof well area for receiving bulk ice.

These and other objects and advantages of the invention will become apparent from a review of the drawings and from a complete reading of the description of the preferred embodiment hereinafter given by way of illustration only.

BRIEF DESCRIPTION OF THE DRAWINGS

FIG. 1 is a perspective view of the Applicant's new and novel picnic cooler shown in a closed package condition and having a plurality of beverage cans positioned within the cooler;

FIG. 2 is a perspective view of the cooler shown in FIG. 1 showing the plurality of top side flaps being repositioned to a vertical position preliminary to forming the upper water-proof well area of the Applicant's invention;

FIG. 3 is a perspective view of the picnic cooler shown in FIG. 2 further showing the top end flaps being repositioned between the plurality of beverage cans and the ends of the cooler and further showing the plurality of beverage cans positioned in the cooler;

FIG. 4 is a perspective view of the picnic cooler shown in FIG. 3 showing a plurality of bulk ice placed within the upper water-proof well area and on top of the multiple article beverage cans;

DESCRIPTION OF THE PREFERRED EMBODIMENT

Figure 5:
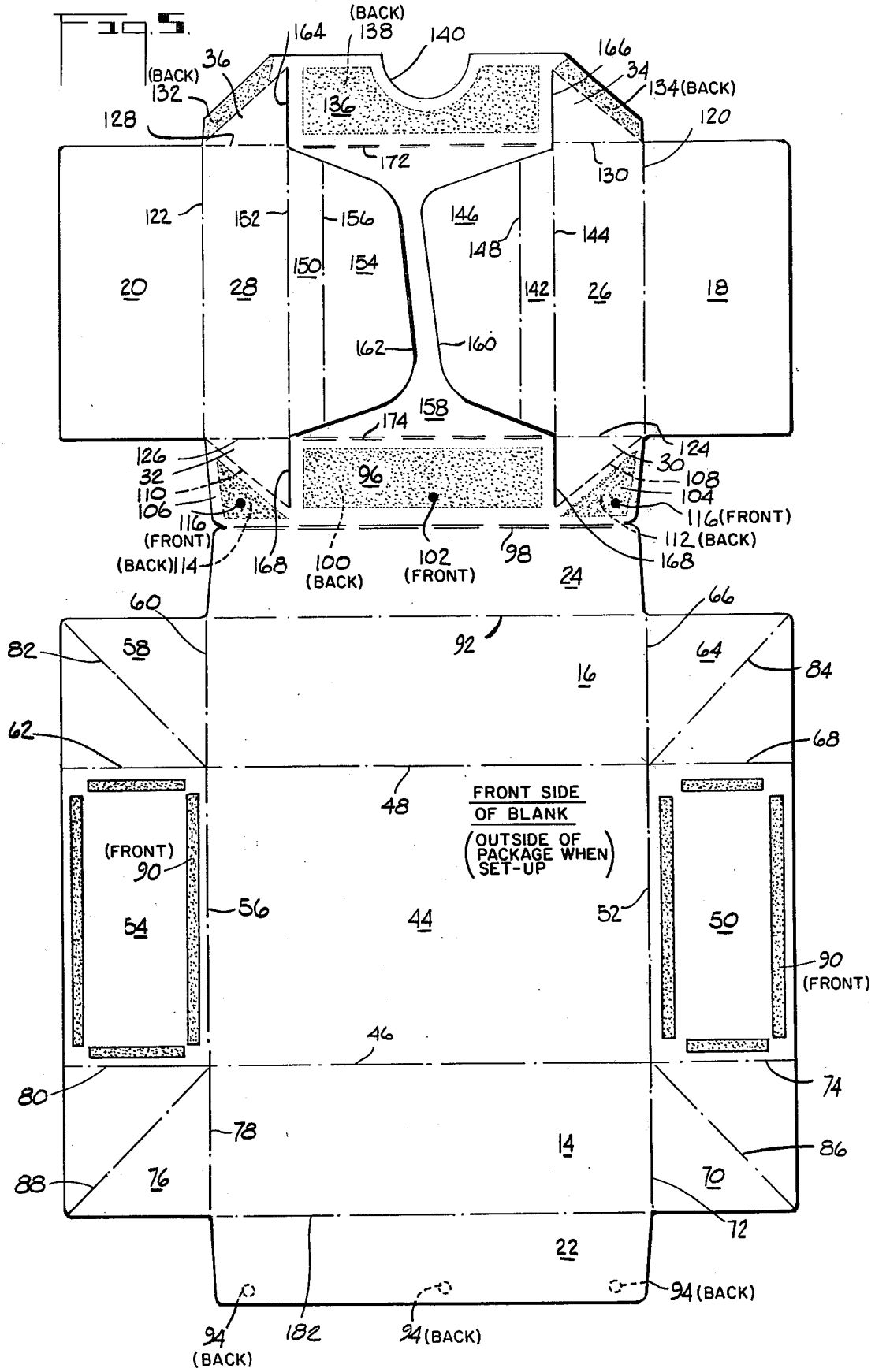
FIG. 5 is a plan view of the front side or printed outside of a production blank for the picnic cooler shown in FIGS. 1–4 and also showing the positioning of the adhesive on the front and back side on various panels and flaps of the blank.

Referring now to the drawings in general and in particular to FIGS. 1–4 there is shown in perspective views the Applicant's new and novel picnic cooler shown generally by the numeral 10. The cooler comprises a lower water-tight area 12 formed in a manner which will be described more fully hereinafter from a plurality of side panels 14 and 16 and from a plurality of end panels 18 and 20. The side panel 16 and end panel 20 cannot be seen in the FIGS. 1–4 but can be seen in FIG. 5. The side panel 14 has a top side flap 22 hingedly attached thereto while the side panel 16 has a top side flap 24 hingedly attached thereto. In a like manner the end panel 18 has a top end flap 26 hingedly attached thereto while the end panel 20 has a top end flap 28 hingedly attached thereto. A bottom panel 44 (not shown in FIG. 1–4) is hingedly connected to the side panels 14 and 16 and to the end panels 18 and 20.

Referring now to FIG. 2 of the drawing there is shown a perspective view of the cooler shown in FIG. 1 showing how the plurality of top side flaps 22 and 24 may be repositioned to a vertical position preliminary to forming the upper water-proof well area of the Applicant's invention. The top side flaps 22 and 24 are hingedly attached their respective top end flaps 26 and 28 by a plurality of top gusset panels as shown in FIG. 2 of the drawing. For example, the top side flap 24 would be hingedly attached to the top end flap 26 by a top gusset panel 30 while the top side flap 24 and the top end flap 28 would be hingedly attached to each other by means of a top gusset panel 32. In a like manner, but not shown on the drawing FIG. 2, the top side flap 22 would be hingedly attached to the top end flap 26 by a top gusset panel 34 and in a like manner the top side flap 22 would be hingedly attached to the top end flap 28 by means of a top gusset panel 36.

When formed thusly, the top side flaps 22 and 24 and the top end flaps 26 and 28 along with their corresponding top gusset panels 30, 32, 34 and 36 form the upper water-proof well area shown generally by the numeral 38 as illustrated in FIG. 3. The illustration of FIG. 3 is a perspective view of the picnic cooler shown in FIGS. 1 and 2 further showing the top end flaps being repositioned between the plurality of beverage cans 40 and the ends of the cooler and further showing the plurality of beverage cans 40 positioned in the cooler.

When the top side flaps 22 and 24 along with the top end flaps 26 and 28 are folded downwardly, the flaps are positioned horizontally over the beverage cans 40 as shown in FIG. 1 of the drawing and provide protection on the tops of the beverage cans from dust and other environmental elements. It can be seen by referring to FIG. 2 how the top side flaps 22 and 24 may then be repositioned to a vertical position after which the top end flaps 26 and 28 may also be repositioned to a vertical position to provide the upper water-proof well area 38 as shown in FIG. 3 of the drawing. Thereafter the upper water-proof well area 38 is capable of receiving a quantity of bulk ice 42 which may be positioned within the upper water-proof well area 38 on top of the beverage cans 40 to completely ice and cool the beverage cans 40 contained within the cooler 10.

Referring now to FIG. 5 of the drawing there is shown in detail a plan view of the front printed outside of a production blank for the picnic cooler 10 shown in FIGS. 1–4 which will also show the positioning of the various adhesives on the front and back side as used on the various panels and flaps of the blank in order to achieve the water-proof areas.

A central bottom panel 44 is hingedly attached to the side panels 14 and 16 by means of the scorelines 46 and 48. In addition, the bottom panel 44 is hingedly attached to a lower end panel 50 by means of the scoreline 52. A second lower end panel 54 is hingedly attached to the bottom panel 44 by means of the scoreline 56. Hingedly attached to the side panels 14 and 16 and the lower end panels 50 and 54 are a plurality of end panel gussets which form the joining means for joining the panels together to provide the lower water-tight area 12 before mentioned. For example, the side panel 16 is hingedly attached to the lower end panel 54 by means of the end panel gusset 58 at the scorelines 60 and 62. In a similar manner the side panel 16 is hingedly attached to the lower end panel 50 by means of the end panel gusset 64 at the scorelines 66 and 68. The side panel 14 is hingedly attached to the lower end panel 50 by means of the end panel gusset 70 at the scorelines 72 and 74. In a like manner the side panel 14 is hingedly attached to the lower end panel 54 by the end panel gusset 76 at the scorelines 78 and 80.

The end panel gussets 58, 64, 70 and 76 each has formed therein a diagonal scorelines 82, 84, 86 and 88 which allows the end panel gussets to be folded as will be described more fully hereinafter to form the lower water-tight area 12.

The lower end panels 50 and 54 have applied thereto a predetermined pattern of adhesive 90 as shown by the stipled area in FIG. 5 of the drawing. A line around the stipled area indicates adhesive coverage on the front side of the blank. The predetermined pattern of adhesive 90 would be applied to the front side of the production blank by the customer of the production blank. The top side flap 22 also has applied thereto predetermined spots of adhesive 94 as shown by the dotted circles in the respective positions in FIG. 5. The adhesive spots 94 are applied to the back side of the production blank and are used to hold the flap 22 down in the position shown in FIG. 1 of the drawing.

The side panel 16 is hingedly attached, by means of the scoreline 92, to the top side flap 24 which is in turn hingedly attached to an inner glue flap in the form of the first elongated panel 96 and two triangular shaped inner glue flaps 104 and 106 by means of the cut and scoreline 98. The first elongated panel 96 also has a predetermined pattern of adhesive 100 (shown by stippling) applied thereto as well as a spot of adhesive 102 (shown by the heavy black dot) applied in the position shown in the drawing. The adhesive spot 102 would be applied on the front side of the paperboard forming the production blank while the adhesive pattern 100 would be applied on the back side of the same board.

The top gusset panels 30 and 32 are hingedly attached to the triangular shaped inner glue flaps 104 and 106 by means of the scorelines 108 and 110. The triangular shaped inner glue flaps 104 and 106 have applied thereto predetermined patterns and spots of adhesive 112, 114, 116. The adhesive pattern 112 (shown by stippling) applied to the inner glue flap 104 is applied to the back side of the production board while the adhesive spot 116 (shown by the heavy black dot) applied to the same inner glue flap is applied to the front side of the board. In a like manner the adhesive pattern 114 (shown by stippling) applied to the inner glue flap 106 is applied to the back side of the board while the adhesive spot 116 (shown by the heavy black dot) applied to the same inner glue flap is applied to the front side of the board. The adhesive spots 102 and 116 are used to hold the flap 24 and panel 96 in the position shown in FIG. 1 of the drawings.

The upper end panel 18 is hingedly attached to the top end flap 26 by means of the scoreline 120. In a similar manner the upper end panel 20 is hingedly attached to the top end flap 28 by means of the scoreline 122. The top end flap 28 is also hingedly attached to the top gusset panel 32 by means of the scoreline 126. In a similar manner the top end flap 26 is hingedly attached to the top gusset panel 30 by means of the scoreline 124.

The top end flap 28 is also hingedly attached to the top gusset panel 36 by means of the scoreline 128 and in a similar manner the top end flap 26 is hingedly attached to the top gusset panel 34 by means of the scoreline 130. The top gusset panels 36 and 34 have applied thereto a pattern of adhesive 132 and 134 (shown by stippling). The adhesive pattern 132, applied to the top gusset panel 36 would be applied to the back side of the production blank board and in a similar manner the adhesive pattern 134 applied to the top panel gusset 34 would also be applied to the back side of the board.

There is positioned between the top gusset panel 34 and the top gusset panel 36 an outer glue flap in the form of a second elongated panel 136 which has applied thereto a pattern of adhesive 138 (shown by stippling) applied to the back side of the production blank board. The elongated panel 136 also has formed therein a semicircular cutout 140 as shown in FIG. 5 of the drawing.

The top end flap 26 is hingedly attached to an elongated panel 142 by means of the scoreline 144 and also to an irregular shaped panel 146 by means of the scoreline 148. In a similar manner the top end flap 28 is hingedly attached to an elongated panel 150 by means of the scoreline 152 and is also hingedly attached to an irregular shaped panel 154 by means of the scoreline 156. When formed thusly, the irregular shaped panels 146 and 154 form an I-shaped panel 158 which is separated from the irregular shaped panels 146 and 154 by means of the irregular shaped die-cut lines 160 and 162. In a similar manner the top gusset panel 36 is separated from the second elongated panel 136 by means of the die-cut line 164 and the top gusset panel 34 is separated from the second elongated panel 136 by means of the die-cut line 166.

The top gusset panel 32 is separated from the first elongated panel 96 by means of the die-cut line 168 and the top gusset panel 30 is separated from the first elongated panel 96 by means of the die-cut line 168. The I-shaped panel 158 is hingedly attached to the second elongated panel 136 by means of the cut and scoreline 172 and is also hingedly attached to the first elongated panel 96 by means of the cut and scoreline 174.

When formed thusly, it can be seen that the top end flap 26 and the top end flap 28 along with their connecting panels 142, 146, 150 and 154 may be easily torn out of the I-shaped panel 158 as shown in FIG. 3 of the drawing whenever the upper water-proof well area 38 is being formed to receive the quantity of bulk ice 42.

Figure 6:
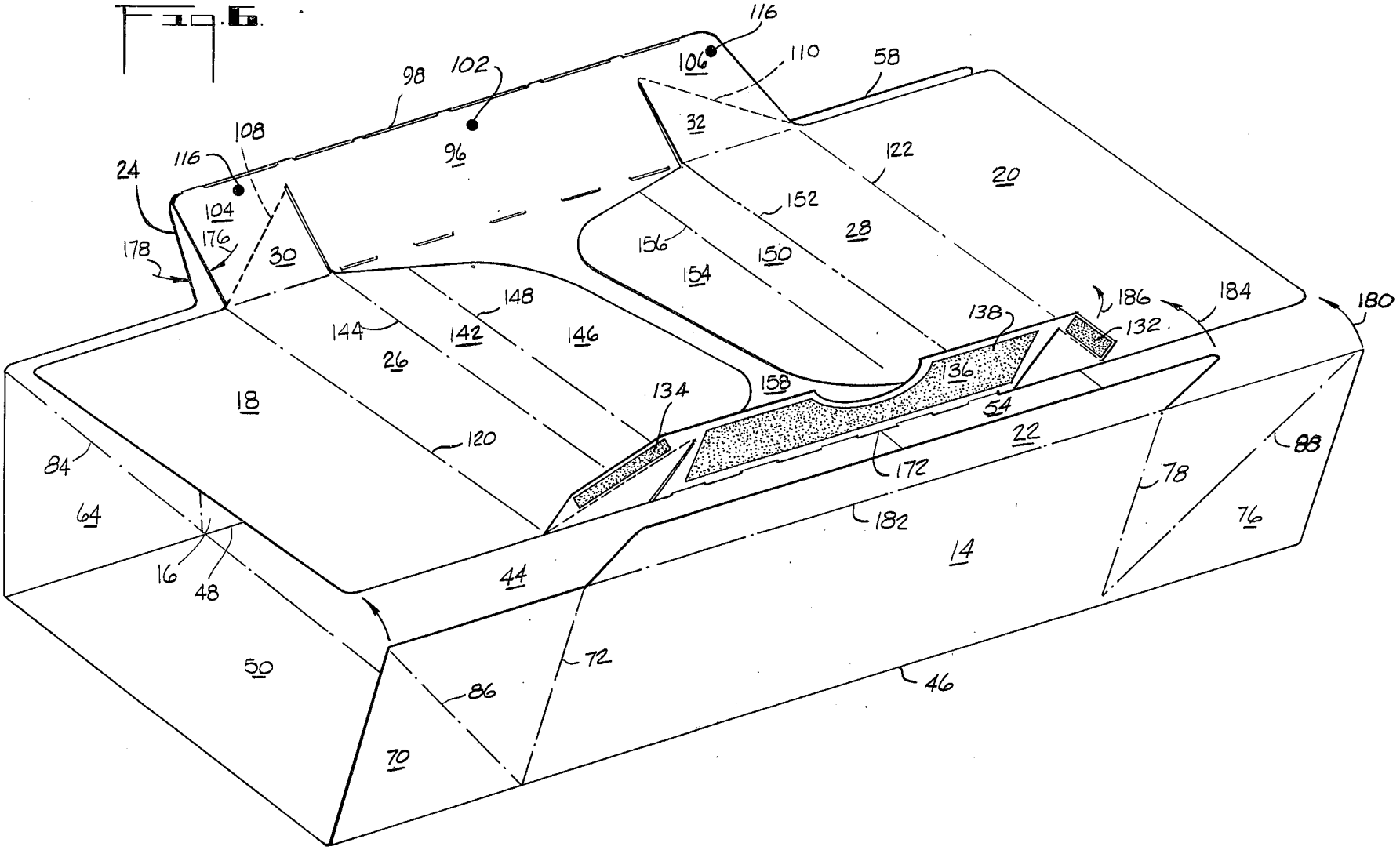
FIG. 6 is a perspective view of the production blank shown in FIG. 5 showing the folding sequence for forming the production blank into a completed picnic cooler.

Referring now to FIG. 6 of the drawing there is shown a perspective view of the production blank shown in FIG. 5 showing the folding sequence for forming the production blank into a completed picnic cooler. When forming the cooler structure, the first elongated panel 96 and the top side flap 24 would be folded together about the scoreline 98 in the direction shown by the arrows 176 and 178. In a similar manner the side panel 14 would be folded upwardly about the scoreline 46 as shown by the arrow direction 180. In addition the top side flap 22 would be folded about the scoreline 182 in the direction shown by the arrow 184 to lie in juxtaposition with the second elongated panel 136 which had previously been folded upwardly about the scoreline 172 as shown by the arrow direction 186. It will also be noted that the bottom panel 44 will have been previously folded from the side panel 16 along the scoreline 48 to the position shown in FIG. 6 of the drawing.

Figure 7:
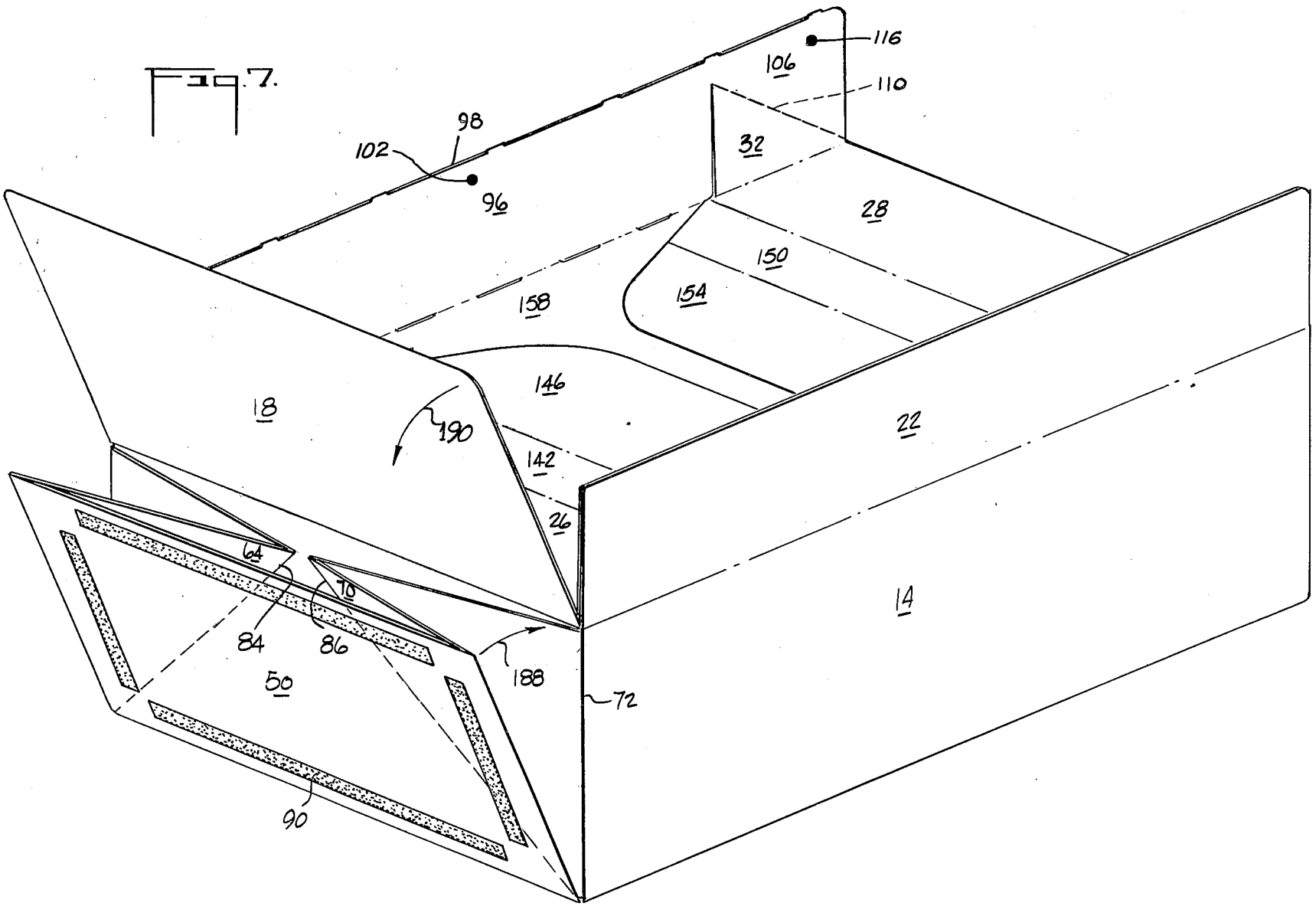
FIG. 7 is a perspective view of the production blank shown in FIG. 6 further showing the folding sequence of closing the end panels of the picnic cooler after a plurality of multiple article beverage cans or the like have been positioned in the package.

Referring now to FIG. 7 of the drawing there is shown a perspective view of the production blank shown in FIG. 6 further showing the folding sequence of closing the end panels of the picnic cooler after a plurality of multiple article beverage cans or the like have been positioned in the package. In FIG. 7 of the drawing the end panel 18 has been shown in an almost vertical position for purposes of clarity and to permit showing how the lower end panel 50 is folded. The end panel gussets 64 and 70 are folded about their respective scorelines 84 and 86 to the position shown in FIG. 7 of the drawing and thereafter the lower end panel 50 is folded inwardly as shown by the arrow direction 188. At the completion of this folding step, the end panel 18 would be folded downwardly in the direction shown by the arrow 190 to lie in juxtaposition with the lower end panel 50. It can be seen in FIG. 7 that the adhesive 90, which had been previously applied by the customer to the front side of the production blank would then be utilized to adhesively secure the end panel 18 in juxtaposition with the lower end panel 50.

In a similar manner the opposite lower end panel 54 would be folded along with its end panel gussets 58 and 76 into juxtaposition with the upper end panel 20 and would be adhesively secured thereto by means of the adhesive 90.

Figures 8, 9, 10:
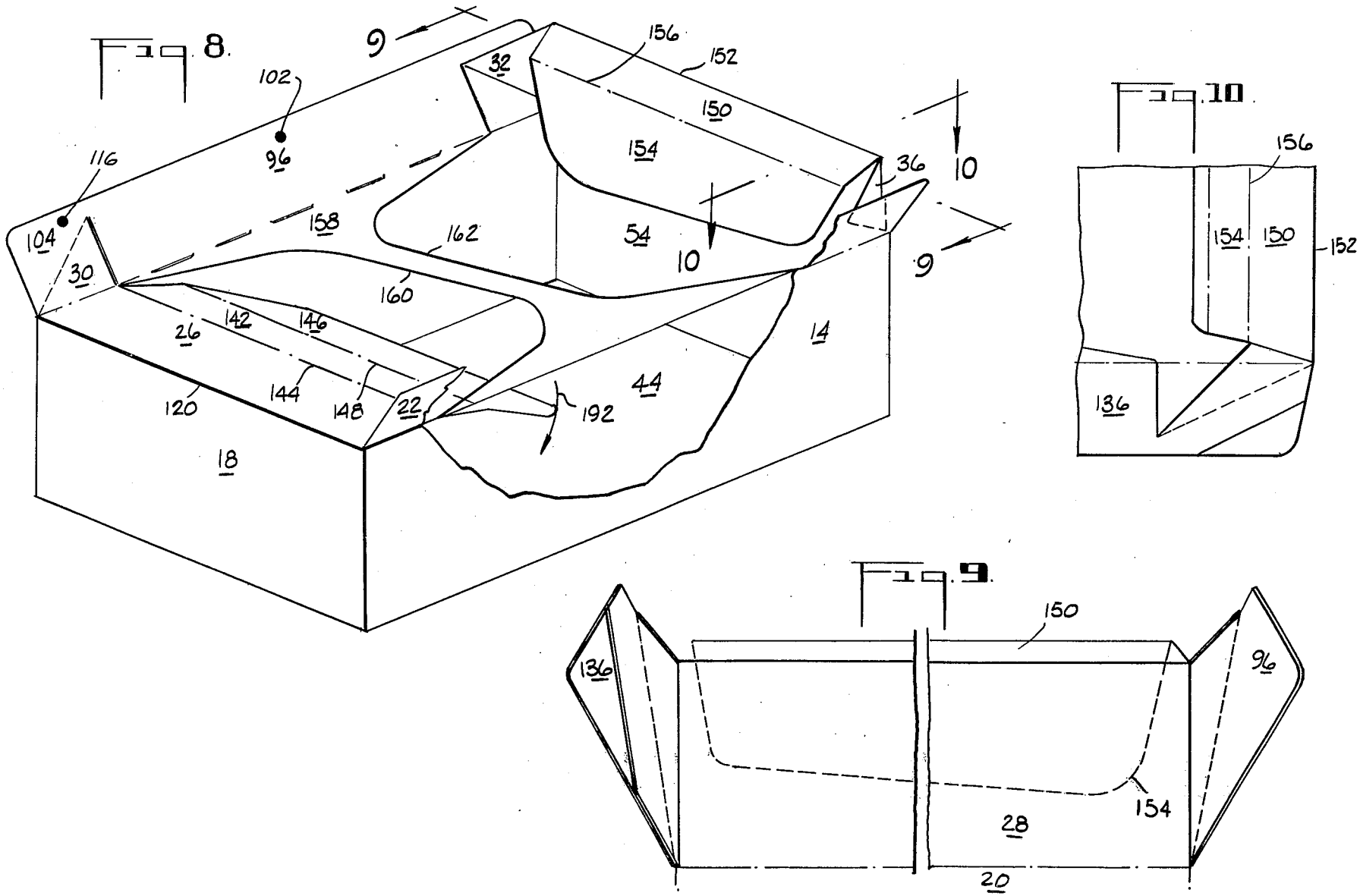
FIG. 8 is a perspective view of the folded production blank shown in FIG. 7 showing further the positioning of the top side and end flaps of the picnic cooler.
FIG. 9 is an end view, taken along line 9—9 of FIG. 8 showing the end formation of the respective panels and flaps of the subject invention.
FIG. 10 is a top view, taken along line 10—10 of FIG. 8 showing the further folding of the various flaps and panels of the subject invention.

Referring now to FIG. 8 of the drawing there is shown a perspective view of the folded production blank shown in FIG. 7 showing further the positioning of the top side and end flaps of the picnic cooler. In FIG. 8 of the drawing the top side flap 22 and the side panel 14 have been shown broken away in order to fully illustrate the functioning of the various panels. In addition the cooler has been shown without having a plurality of beverage cans 40 or the like positioned therein. It can be seen in FIG. 8 by referring to the left hand side of FIG. 8 how the irregular shaped panel 146 as well as the elongated panel 142 have been positioned downwardly in the direction shown by the arrow 192. When relocated thusly, they would be torn out from the die-cut line 160 and the top end flap 26 would then be ready for folding upwardly about the scoreline 120. For this latter condition, reference should be made to the right hand side of the FIG. 8 drawing wherein there is shown the upward folding of the irregular shaped panel 154 and the elongated panel 150 about the scorelines 152 and 156. It can be seen then how the respective top gusset panels 32 and 36 would fold allowing the elongated panel 150 and the irregular shaped panel 154 to be raised to the position shown in FIG. 8. Thereafter these panels would be tucked down inside the container between the plurality of beverage cans 40 and their respective lower end panel 54. This condition is shown more clearly in FIG. 3 of the drawing which also shows how the elongated panel 142 and the irregular shaped panel 146 would be folded between the plurality of beverage cans 40 and their respective lower end panel 50.

Referring now to FIG. 9 of the drawing there is shown an end view, taken along line 9—9 of FIG. 8 showing the end formation of the respective panels and the flaps of the subject invention.

Referring now to FIG. 10 of the drawing there is shown a partial top view, taken along line 10—10 of FIG. 8 showing the further folding of the various flaps and panels of the subject invention. The view in FIG. 10 is shown broken and illustrates only one side of the folding of the elongated panel 150 and the irregular shaped panel 154.

It can be seen by the foregoing description of the preferred embodiment that there has been provided a new and novel picnic cooler container wherein cans may be inserted into the container through the ends of the container package. The new and novel container is designed to be opened by the purchaser of the container with the container being designed to receive a quantity of bulk ice placed in an upper water-proof well area formed above the lower water-proof container area. While many changes may be made in the various parts of the invention shown herein it is within the spirit and scope of the invention that those changes would be encompassed by the subject invention as shown and detailed in the preferred embodiment which has been given by way of illustration only.

Having described my invention, I claim:

1. A production blank for forming a picnic cooler having a lower beverage can or bottle retaining area and an upper ice retaining area when formed into a complete package, comprising:

(1) the lower beverage can or bottle retaining area formed with:

a. a bottom panel having a plurality of side edges:

b. a pair of opposed lower end panels hingedly attached to two opposed side edges of the bottom panel:

c. a pair of side panels hingedly attached to the remaining two opposed side edges of the bottom panel;

d. means, associated with the lower end panels and the side panels for joining the panels together; and (2) the upper ice retaining area is formed with;

a. a pair of top side flaps hingedly attached to each side panel;

(1) a first inner glue flap hingedly attached to one of the top side flaps, the first inner glue flap comprising a first elongated panel and a first pair of triangular shaped panels and having hingedly attached thereto on each side thereof a first top gusset panel;

(2) a top end flap hingedly attached to each first top gusset panel;

[a] an upper end panel hingedly attached to one side of each top end flap; the upper end panels forming a part of the lower retaining area whenever the blank is formed into a package;

(3) a second pair of triangular shaped panels hingedly attached to the other side of each top end flap;

(4) a second elongated panel hingedly attached to the pair of second triangular shaped panels;

[a] an irregular shaped panel hingedly attached to each of the first and second elongated panels; one side of each of the two irregular shaped panels terminating opposite each other and spaced apart to form a central I-shaped panel which is hingedly attached on one side thereof to the first elongated panel and on the other side thereof to the second elongated panel; the two top side flaps in combination with the two top end flaps and the first and second inner glue flaps serving as a part of the upper ice retaining area whenever the production blank is formed into a complete package; the elongated panels and the irregular shaped panels serving as a removable cover to cover the tops of the cans or bottles packed in the cooler.

2. The production blank as defined in claim 1 further comprising the joining means comprising a plurality of gusset panels hingedly attached to the side panels and the lower end panels.

3. The production blank as defined in claim 1 further comprising the lower end panels having applied thereto a pattern of adhesive on the front side of the production blank.

4. The production blank as defined in claim 3 further comprising the first and second inner glue flaps having applied thereto a pattern of adhesive on the back side of the production blank.

5. The production blank as defined in claim 4 further comprising the first inner glue flap having applied thereto at least a spot of adhesive on the front side of the production blank and further comprising one of the top side flaps having applied thereto at least a spot of adhesive on the back side of the production blank.

6. A picnic cooler container for use in packaging a plurality of multiple articles such as cans of beverage, the container having a lower beverage can or bottle retaining area and an upper ice retaining area when formed into a complete package, comprising:

(1) the lower beverage can or bottle retaining area formed with:

a. a bottom panel having a plurality of side edges;

b. a pair of opposed lower end panels hingedly attached to two opposed side edges of the bottom panel;

c. a pair of side panels hingedly attached to the remaining two opposed side edges of the bottom panel;

d. means, associated with the lower end panels and the side panels for joining the panels together; and (2) the upper ice retaining area formed with;

a. a pair of top side flaps hingedly attached to each side panel;

(1) a first inner glue flap hingedly attached to one of the top side flaps, the first inner glue flap comprising a first elongated panel and a first pair of triangular shaped panels and having hingedly attached thereto on each side thereof a first top gusset panel;

(2) a top end flap hingedly attached to each first top gusset panel;

(a) an upper end panel hingedly attached to one side of each top end flap; the upper end panels forming a part of the lower retaining area whenever the blank is formed into a package;

(3) a second pair of triangular shaped panels hingedly attached to the other side of each top end flap;

(4) a second elongated panel hingedly attached to the pair of second triangular shaped panels;

(a) an irregular shaped panel hingedly attached to each of the first and second elongated panels; one side of each of the two irregular shaped panels terminating opposite each other and spaced apart to form a central I-shaped panel which is hingedly attached on one side thereof to the first elongate panel and on the other side thereof to the second elongated panel; the two top side flaps in combination with the two top end flaps and the first and second inner glue flaps serving as a part of the upper ice retaining area whenever the production blank is formed into a complete package; the elongated panels and the irregular shaped panels serving as a removable cover to cover the tops of the cans or bottles packed in the picnic cooler.

7. The picnic cooler container as defined in claim 6 further comprising the joining means comprising a plurality of gusset panels hingedly attached to the side panels and the lower end panels.

8. The picnic cooler as defined in claim 6 further comprising the lower end panels having applied thereto a pattern of adhesive on the front side of the production blank used in forming the picnic cooler.

9. A picnic cooler container as defined in claim 8 further comprising the first and second inner glue flaps having applied thereto a pattern of adhesive on the back side of the production blank used in forming the picnic cooler.

10. The picnic cooler container as defined in claim 9 further comprising the first inner glue flap having applied thereto at least a spot of adhesive on the front side of the production blank used in forming the picnic cooler and further comprising one of the top side flaps having applied thereto at least a spot of adhesive on the back side of the production blank used in forming the picnic cooler.

* * * * *